United States Patent [19]

Novack

[11] 4,326,714

[45] Apr. 27, 1982

[54] GAME IMPLEMENT

[76] Inventor: Robert L. Novack, 6 Oxbow Rd., Medfield, Mass. 02052

[21] Appl. No.: 157,857

[22] Filed: Jun. 9, 1980

[51] Int. Cl.[3] ..... A63B 49/02

[52] U.S. Cl. ..... 273/73 C; 273/73 F; 273/73 K

[58] Field of Search ..... 273/67 R, 73 R, 73 C, 273/73 D, 73 F, 73 G, 73 H, 73 K, 75, 76, DIG. 1-10; 124/23 R; 280/610

[56] References Cited

U.S. PATENT DOCUMENTS

| | | | |
|---|---|---|---|
| 2,878,020 | 3/1959 | Robinson | 273/73 F |
| 2,995,379 | 8/1961 | Head | 280/610 |
| 3,171,397 | 3/1965 | Daly | 273/DIG. 3 |
| 3,640,533 | 2/1972 | Davis | 273/73 K X |
| 3,690,658 | 9/1972 | Howe | 273/73 C |
| 3,840,230 | 10/1974 | Schaefer et al. | 273/73 C X |
| 3,850,156 | 11/1974 | Eicholtz | 124/23 R |
| 4,023,799 | 5/1977 | Van Auken | 273/73 C X |
| 4,090,710 | 5/1978 | Williams | 273/75 |
| 4,153,249 | 5/1979 | Plagenhoef | 273/73 C |

FOREIGN PATENT DOCUMENTS

| | | | |
|---|---|---|---|
| 103895 | 5/1938 | Australia | 273/73 F |
| 1173824 | 7/1964 | Fed. Rep. of Germany | 273/76 |
| 2405941 | 8/1975 | Fed. Rep. of Germany | 273/73 D |
| 244566 | 12/1925 | United Kingdom | 273/73 F |
| 352169 | 7/1931 | United Kingdom | 273/73 F |

*Primary Examiner*—Richard J. Apley

*Attorney, Agent, or Firm*—Scott R. Foster

[57] ABSTRACT

A game implement for hitting flying objects, said implement comprising a grip portion and a head portion extending from one end of the grip portion, the head portion having first and second wall portions having different impact characteristics, and indicia on the implement by which a user may perceive which of the wall portions is in a hitting attitude.

16 Claims, 11 Drawing Figures

GAME IMPLEMENT

BACKGROUND OF THE INVENTION

1. Field of the Invention

The invention relates to game devices and more particularly to game implements for hitting flying objects such as tennis balls, table tennis balls, squash balls, shuttlecocks, and the like.

2. Description of the Prior Art

Game implements, such as tennis rackets, of laminar construction are generally known. U.S. Pat. No. 3,856,603 issued Dec. 24, 1974 to William E. Schaefer et al and U.S. Pat. No. 4,023,799, issued May 17, 1977 to Richard L. Van Auken show laminar constructions in which first and second walls are disposed on either side of a core material, the walls comprising opposite face surfaces of the head portion of the racket.

A tennis racket having areas of different flexibility is shown in U.S. Pat. No. 3,647,211, issued Mar. 7, 1972 to James H. Doessel et al. The racket disclosed in the Doessel patent includes a frame of molded plastic. The frame includes head, throat, shaft and handle portions. The frame is so molded as to provide maximum flexibility at the upper end thereof, next greatest flexibility at the throat area, less flexibility at the base of the head portion, still less flexibility at the shaft adjacent the handle, and the least flexibility in the handle. The various degrees of flexibility apply to both sides of the racket.

In U.S. Pat. No. 4,082,275, issued Apr. 4, 1978 to Tsai C. Soong, et al there is shown a racket in which the two sides of the head portion are different. The head portion is "saddle-shaped", making one side somewhat concave and the other convex, thereby providing a different sort of hitting surface on the two sides.

SUMMARY OF THE INVENTION

An object of the present invention is to provide a game implement having two hitting surfaces with different impact characteristics.

A further object of the invention is to provide such an implement having indicia thereon by which a user may perceive which of the hitting surfaces is in a hitting attitude.

With the above and other objects in view, as will hereinafter appear, a feature of the present invention is the provision of a game implement for hitting flying objects, the implement including a grip portion and a head portion extending from one end of the grip portion, the head portion having first and second wall portions forming opposite faces thereof, the first and second walls having different impact characteristics, and indicia on the implement by which a user may perceive which of the wall portions is in a hitting attitude.

The above and other features of the invention, including various novel details of construction and combinations of parts will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENTS

Figure 1:
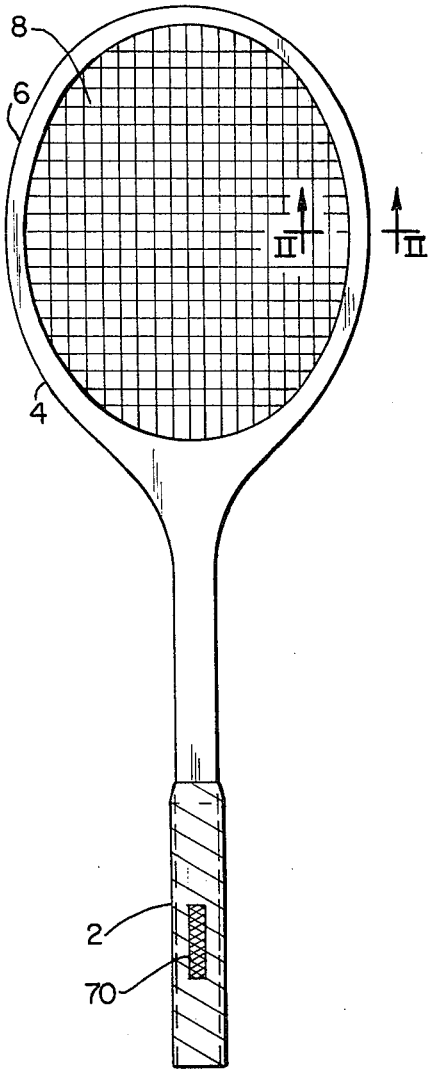
FIG. 1 is a front elevational view of one form of game implement illustrative of an embodiment of the invention.

Referring to FIG. 1 of the drawings, in which a tennis racket is illustrative of a game implement in accorance with the invention, it will be seen that the racket includes a grip portion 2 and a head portion 4. The head portion 4, in the illustrative example, comprises a frame portion 6 adapted to have mounted thereon string means 8.

Figure 2:
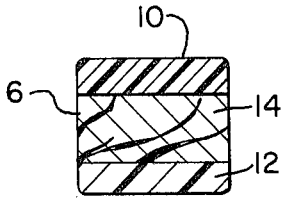
FIG. 2 is a cross-sectional view taken along line II—II of FIG. 1.

In FIG. 2 it will be seen that the frame portion 6 is of laminar construction including a first wall 10 of a given substance, such as plastic, preferably a fiber-reinforced plastic, and a second wall 12 of the same substance, but in the case of fiber-reinforced plastics of lower fiber-resin ratio. The first and second walls 10, 12 form opposite faces of the frame portion 6. The walls 10, 12 are preferably separated by a core 14 of a filler material which may be wood, as illustrated, plastic, or the like. Being of lower fiber-resin ratio, the second wall 12 has a lower modulus in tension than does the first wall 10. The differences in tension moduluses of the opposite faces provide different bending moduluses and therefore different impact characteristics. The second wall 12, for example, will have a lower bending modulus than side 10 and will be relatively more compressive and, in striking a ball, would impact the ball with greater "power" and provide for a more forceful hit. The side 10 of higher bending modulus will be relatively more resistant, or stiff and, in striking a ball, would impact with less "power" but with greater control by the user. Thus, the second wall 12 would be, in effect, a "power" face, and the first wall 10 a "finesse" or "control" face.

Figure 3:
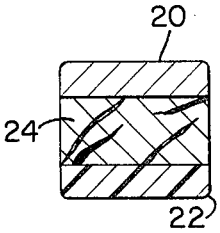
FIGS. 3–7 are similar to FIG. 2 but show alternative embodiments.

In FIG. 3 there is shown an alternative embodiment in which a first wall 20 is of a given first substance, such as metal, and a second wall 22 of a given second substance, such as plastic or fiberglass. Again, a core 24 of wood or of plastic may be used. As in the FIG. 2 embodiment, the two walls 20, 22 provide the opposite faces of the frame portion 6 with different bending moduluses, and therefore different hitting, or impact, characteristics.

Figure 4:
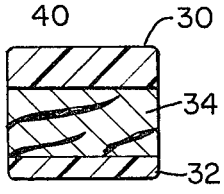
Figure 5:
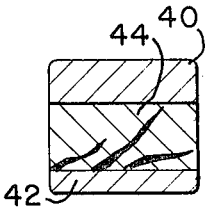
Figure 6:
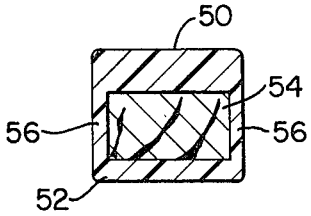

In FIGS. 4 and 6 there are shown other alternative embodiments, in which the first and second walls 30, 40 and 32, 42 are of the same substance, of substantially the same fiber-resin ratio, but are of different thicknesses, to provide different bending moduluses, and therefore different impact characteristics. In FIG. 4, the walls 30, 32 are illustrated as being of plastic or fiberglass and in FIG. 5 the walls 40, 42 are illustrated as being of metal. The core portions 34, 44 may be of wood as illustrated, or plastic.

Figure 7:
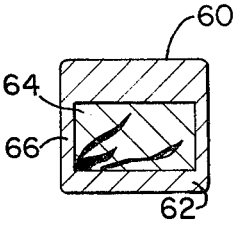

The frame portion 6 may be of tubular configuration including, as illustrated in FIGS. 6 and 7, first walls 50, 60 and second walls 52, 62 interconnected by side walls 56, 66. As in the other embodiments, a core material 54, 64 may be used.

So that a user may know which of the two sides is in a hitting attitude, indicia are provided to facilitate ready perception by the user as to the orientation of the hitting faces. Referring again to FIG. 1, it will be seen that the grip portion may be provided with a roughened portion 70 by which the user may tell by "feel" which side, or hitting surface, is forward. The roughened portion 70 is disposed on one side only of the grip portion, so that the difference between the smoother surface on one side and the roughened portion on the other side will be readily perceptible.

Figure 8:
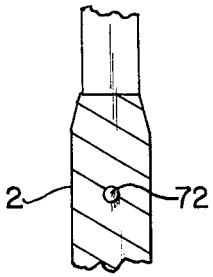
FIGS. 8 and 9 are partial front elevational views of the grip portion, similar to a portion of FIG. 1, but showing alternative embodiments of the grip portion.
Figure 9:
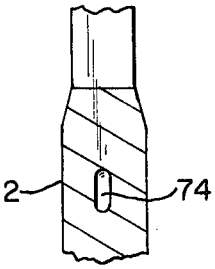

Alternatively, the grip portion 6 may be provided with a protuberance 72 or bead (FIG. 8) or a recess or perforation 74 (FIG. 9) on one side of the grip portion, or a protuberance on one side and a recess on the other side. In still another embodiment, the frame portion 6 may be color-coded so that the user may perceive visually which side is in hitting position.

Figure 11:
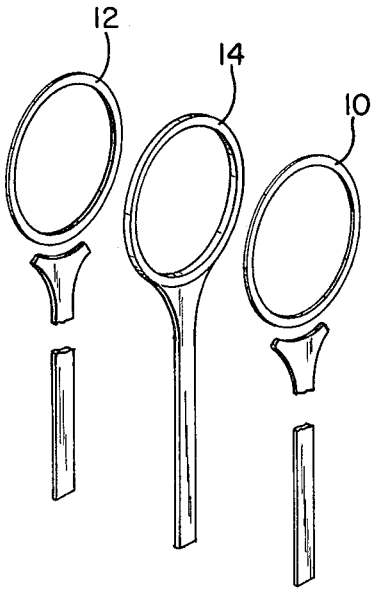
FIG. 11 is an exploded perspective view of an alternative construction.
Figure 10:
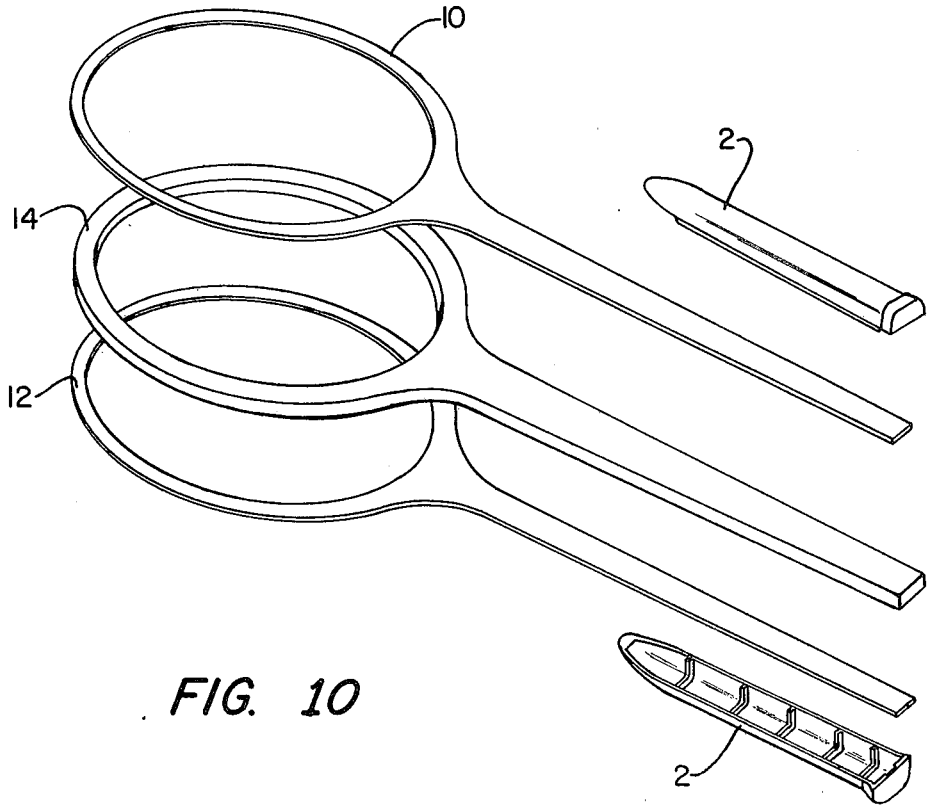
FIG. 10 is an exploded perspective view of the implement of FIG. 1.

Referring to FIG. 10, it will be seen that the first and second walls 10, 12, and the core 14, may each comprise a portion of the entire racket; or, as shown in FIG. 11, the first and second walls 10, 12 may comprise portions of the head portion 4 only.

In use, a player has the option of using the "control" side (10, 20, 30, 40, 50, 60) or the "power" side (12, 22, 32, 42, 52, 62) for a particular hit. For example, a player might elect to serve using the power side and perhaps forehand volley using the same side. He may switch to the control side for baseline strokes. The power side may be used to enhance strokes of a player which are ordinarily weak, as is sometimes the case with backhand strokes compared to a player's forehand strokes. The mix of uses is, of course, entirely within the discretion of the player. At all times, the aforementioned indicia enables the player to be aware of which side is in the impact position.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A game implement for hitting flying objects, said implement comprising a grip portion and a head portion extending from one end of said grip portion, said head portion comprising a frame portion adapted to have mounted thereon single string means, said frame portion having first and second wall portions forming opposite faces of said frame portion, a first of said faces being disposed outwardly from a plane of said string means in a first direction and a second of said faces being disposed outwardly from said plane in a second direction, said first and second wall portions having different impact characteristics, and indicia on said implement by which a user may perceive which of said wall portions is in a hitting attitude.

2. The invention is accordance with claim 1 in which said first wall portion is of a first substance and said second wall portion is of a second substance.

3. The invention in accordance with claim 2 in which said first wall portion is of metal and said second wall portion is of plastic.

4. The invention in accordance with claim 1 in which said first and second wall portions are of the same material.

5. The invention in accordance with claim 4 in which said first wall portion is of a different modulus in tension than said second wall portion.

6. The invention in accordance with claim 4 in which said first wall portion is thicker than said second wall portion.

7. The invention in accordance with claim 1 including a core material disposed between said first and second wall portions.

8. The invention in accordance with claim 1 in which said indicia comprises a structural feature on said grip portion which is adapted to be felt by the user's hand.

9. The invention in accordance with claim 8 in which said structural feature comprises a roughened portion.

10. The invention in accordance with claim 8 in which said structural feature comprises a protuberance.

11. The invention in accordance with claim 8 in which said structural feature comprises a recess.

12. The invention in accordance with claim 1 in which said indicia comprises an appearance feature on said implement.

13. The invention in accordance with claim 12 in which said appearance feature comprises a portion of said first wall being of a different color than said second wall.

14. A game racket for hitting flying objects, said racket comprising a grip portion and a frame portion extending from one end of said grip portion, said frame portion being adapted for mounting of a single string network thereon, said frame portion having first and second wall portions forming opposite faces of said frame portion, a first of said faces being disposed outwardly from a centerline plane of said string network in a first direction and a second of said faces being disposed outwardly from said centerline plane in a second direction, said first and second wall portions having different bending moduluses, and indicia on said racket by which it is apparent to a user which of said wall portions is in a hitting attitude.

15. The invention in accordance with claim 14 in which said wall portions are part of a tubular member and said wall portions are interconnected by side wall portions.

16. The invention in accordance with claim 15 including a core material disposed in said tubular member.

* * * * *